US012774816B2

(12) United States Patent
De Borba et al.

(10) Patent No.: US 12,774,816 B2
(45) Date of Patent: Oct. 27, 2026

(54) COOKTOP WITH INTEGRATED GRIDDLE

(71) Applicant: WHIRLPOOL CORPORATION, Benton Harbor, MI (US)

(72) Inventors: Daniel Fernando De Borba, Joinville (BR); Santiago J. Ospina, Joinville (BR)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 363 days.

(21) Appl. No.: 18/416,074

(22) Filed: Jan. 18, 2024

(65) Prior Publication Data

US 2025/0237391 A1 Jul. 24, 2025

(51) Int. Cl.
*F24C 15/10* (2006.01)

(52) U.S. Cl.
CPC ..... *F24C 15/107* (2013.01)

(58) Field of Classification Search
CPC ..... F24C 15/107
See application file for complete search history.

(56) References Cited

U.S. PATENT DOCUMENTS

| | | | | |
|---|---|---|---|---|
| 5,313,928 | A * | 5/1994 | Rodgers | A47J 37/0763 126/41 R |
| 7,301,128 | B2 * | 11/2007 | Li | A47J 36/38 219/465.1 |
| 10,598,389 | B2 * | 3/2020 | Cowan | F24C 15/107 |
| 11,162,689 | B2 * | 11/2021 | Bardal | F24C 15/107 |
| 12,150,591 | B2 * | 11/2024 | De Almeida | A47J 37/0682 |
| 2011/0067577 | A1 | 3/2011 | Riddle et al. | |
| 2012/0318256 | A1 | 12/2012 | Chilton et al. | |
| 2023/0108176 | A1 | 4/2023 | de Almeida et al. | |
| 2023/0309744 | A1 * | 10/2023 | Dickerson | A47J 37/0704 99/340 |

FOREIGN PATENT DOCUMENTS

| | | | | |
|---|---|---|---|---|
| EP | 2792954 | B1 * | 3/2017 | F24C 15/107 |
| WO | WO-2022015344 | A1 * | 1/2022 | A47J 37/067 |

* cited by examiner

*Primary Examiner* — Jesse S Bogue
(74) *Attorney, Agent, or Firm* — Brooks Kushman P.C.

(57) ABSTRACT

A cooktop, or system for cooking a food item, such as over a burner, includes a grate for positioning cooking products, such as pots and pans, over the burner to heat the food items within the cooking products. The grate can be pivotable between a down position and an up position, wherein the grate is positioned over the burner in the down position and pivoted away from the burner in the up position for cleaning. A griddle removably couples to the grate and includes a hook to secure the griddle to the grate when the grate moves among the up position and the down position.

20 Claims, 4 Drawing Sheets

COOKTOP WITH INTEGRATED GRIDDLE

FIELD OF THE DISCLOSURE

This disclosure relates to a household appliance, such as a stove or oven, and more particularly, to a stove or oven having a grate with a griddle.

BACKGROUND

Stovetops, such as gas stovetops, are utilized for cooking food or other activities that require heating materials with heightened temperatures. Stovetops that utilize combustible fuels, such as gas or charcoal, often utilize a grate assembly to permit positioning of food items or cookware above the combusted fuels.

SUMMARY

In one aspect, the disclosure relates to a cooktop comprising: a grate, arranged as a set of interconnected tines and movable between a down position wherein the grate is positioned over a burner and an up position wherein the grate is spaced away from the burner; a griddle, removably coupled to the grate, the griddle including a cooking surface and an underside of the griddle opposite the cooking surface; and a hook extending from the underside of the griddle and wherein the hook secures the griddle to the grate including when the grate is in the up position, the down position, or moving between the up position and the down position.

In another aspect, the disclosure relates to a griddle removably attachable to a grate arranged on a cooktop, the grate movable between an up position and a down position, the griddle comprising: a cooking surface; an underside opposite of the cooking surface; and at least one hook extending from the underside; wherein the hook secures the griddle to the grate during movement of the grate between the up position and the down position.

DETAILED DESCRIPTION

As may be appreciated, based on the disclosure, there exists a need in the art for an assembly permitting attachment of a griddle to a cooktop, while retaining attachment of the griddle to the cooktop while lifting a grate on the cooktop for cleaning. Cooking on a cooktop results in dirtying of the cooktop with cooking materials, such as food matter that is spilled or splashed during cooking. The disclosure herein permits a user to be able to clean the cooktop without worry of the attached griddle moving or falling when lifting a grate carrying the griddle, in order to clean the cooktop beneath the grate. The disclosure herein further permits a user to easily detach or reattach the griddle to the grate.

Figure 1:
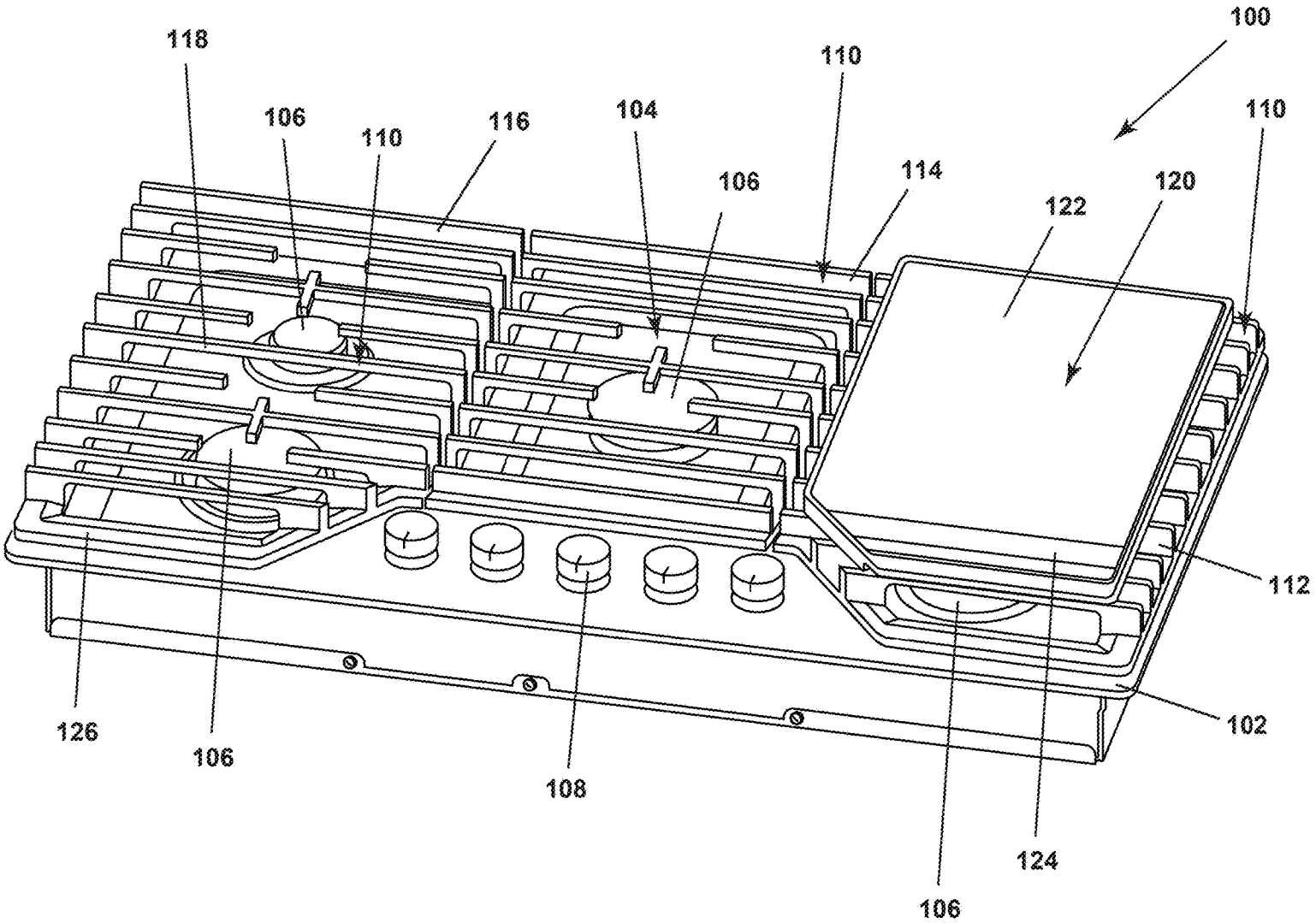
FIG. 1 depicts a cooktop with a grate and with a griddle positioned on a portion of the grate and arranged in a down position, in accordance with an aspect of the present disclosure.

Referring to FIG. 1, a cooktop 100 includes a body 102 defining a cooking area 104. A set of burners 106 are provided on the body 102 within and defining the cooking area 104. The set of burners 106 in a non-limiting example can be gas burners, such as for burning synthetic gas, natural gas, propane, or other flammable liquids, gasses, or fuels in further non-limiting examples to cook or otherwise heat cooking items such as food items within the cooking area 104. While five burners are shown (see FIG. 2, only four are visible in FIG. 1) for the set of burners 106, any number of burners are contemplated, including one or more. A set of controllers, depicted as knobs 108, are utilized to control operation of the set of burners 106, such as turning the set of burners 106 on and off, as well as controlling flame size or heat produced at the set of burners 106. In the illustrated example, each of the set of burners 106 has a corresponding one of the knobs 108.

A set of grates 110 is positioned on at least a portion of the body 102 of the cooktop 100 within the cooking area 104. The set of grates 110 can be separated into a first grate 112, a second grate 114, and a third grate 116, with the second grate 114 positioned between the first grate 112 and the third grate 116. The set of grates 110 are positioned above and spaced from the set of burners 106 to permit cooking products, such as pots and pans, to be positioned on the set of grates 110 to permit cooking of items such as food products within the cooking products. The set of grates 110 are all arranged in a down position as shown in FIG. 1. The set of grates 110 each include a lower portion 126 that rests upon the body 102. A set of tines 118 protrudes from the lower portion 126 which are generally positioned above the set of burners 106. Each of the first, second, and third grates 112, 114, 116 of the set of grates 110 is formed as the lower portion 126 carrying the set of tines 118, interconnected and arranged to collectively form the first, second, and third grates 112, 114, 116.

A griddle 120 is positioned atop at least a portion of the set of tines 118 of the first grate 112 and can be removably attachable to the first grate 112. The griddle 120 can include a cooking surface 122 for cooking food items, and a well 124 for catching liquid cooking materials, such as grease, for disposal.

Figure 2:
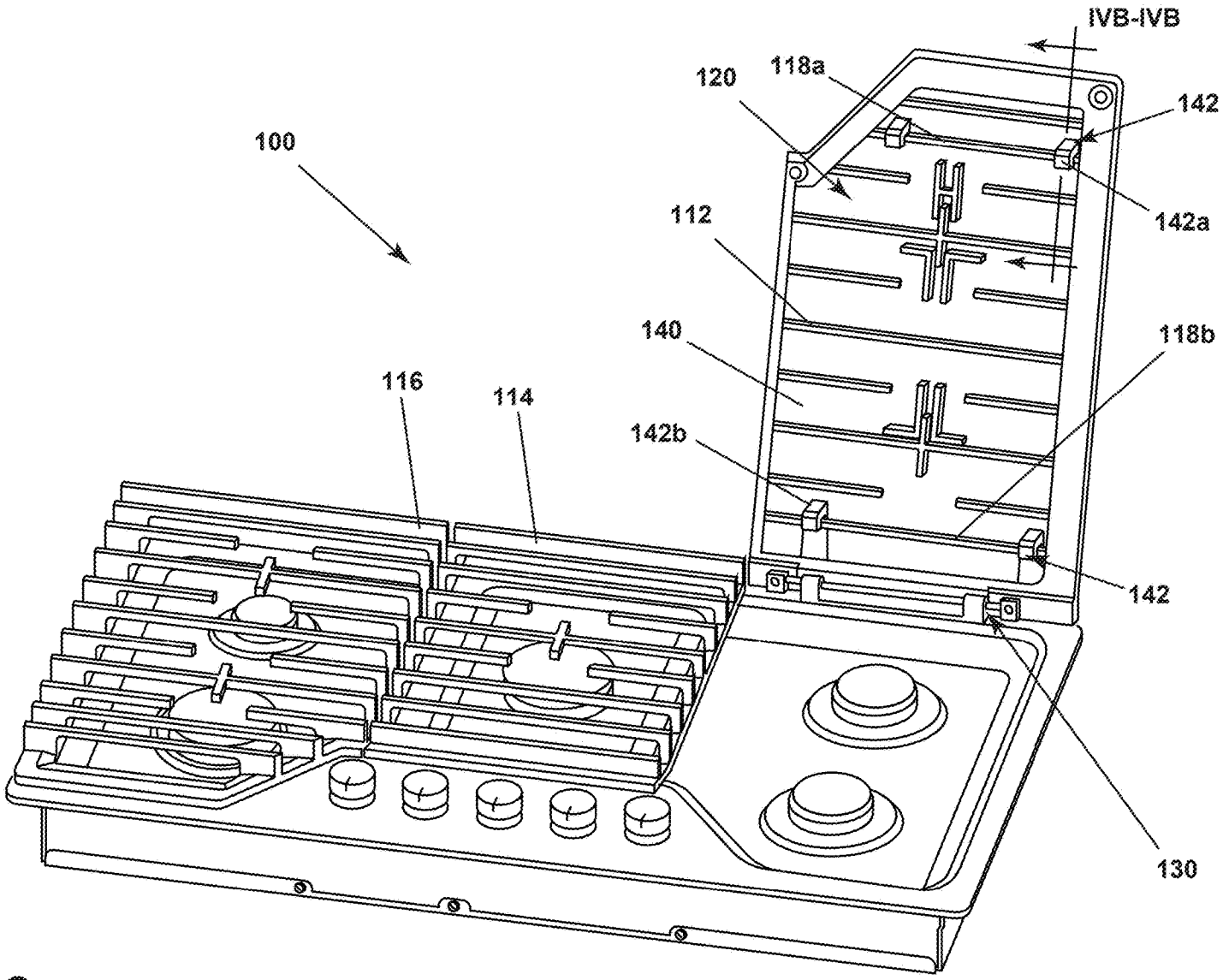
FIG. 2 depicts the cooktop of FIG. 1 with the portion of the grate carrying the griddle arranged in an up position, in accordance with an aspect of the present disclosure.

Referring to FIG. 2, the cooktop 100 is shown with the first grate 112 carrying the griddle 120 shown in an up position. A hinge assembly 130 can pivotably or movably connect or couple the first grate 112 to the body 102 of the cooktop 100 to permit movement of the first grate 112 between the down position (FIG. 1) and the up position (FIG. 2). The second grate 114 and the third grate 116 can include hinge assemblies (not shown) similar to that of the first grate 112, permitting the second grate 114 and the third grate 116 to pivot into the up position, like that of the first grate 112.

As more clearly shown in FIG. 2, the griddle 120 includes an underside 140 including a set of hooks 142 provided thereon. The set of hooks 142 permit attachment of the griddle 120 to the first grate 112. In the illustrated example, the set of hooks 142 includes a first set of hooks 142*a* and a second set of hooks 142*b*. The first set of hooks 142*a* operably retain a tine 118*a* of the set of tines 118 and the second set of hooks 142*b* operably retain a second tine 118*b* of the set of tines 118. Although it will be understood that this need not be the case. Any number of tines of the set of tines 118 may be retained by the set of hooks 142, any number of sets of hooks may be included, and any number of hooks can be included in the set of hooks.

In this manner, the griddle 120 attaches to the first grate 112 and remains attached to the first grate 112 despite movement of the first grate 112 between the up position (FIG. 2) and the down position (FIG. 1). As can be appreciated, a user can easily clean the cooktop 100 beneath the first grate 112 while the first grate 112 is in the up position (FIG. 2). Cleaning with the first grate 112 carrying the griddle 120 in the down position (FIG. 1) is challenging, as the user is required to clean around the first grate 112 and griddle 120, which can inherently prevent the user from cleaning portions of the cooktop 100 covered by the griddle 120 and the first grate 112.

Figure 3:
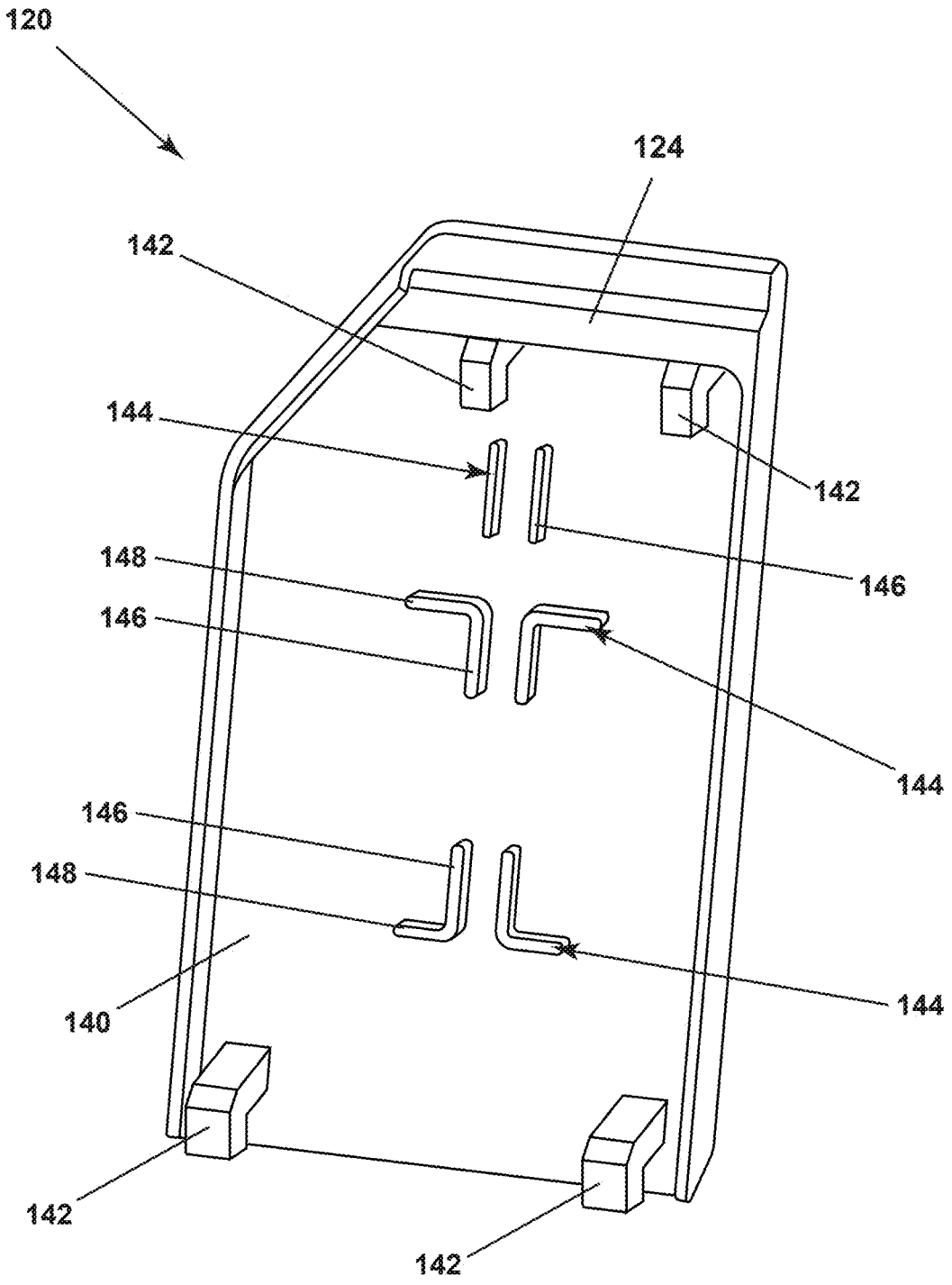
FIG. 3 depicts an underside view of the griddle of FIG. 2 removed from the grate and including a set of hooks, in accordance with an aspect of the present disclosure.

Referring to FIG. 3, it can more easily be seen that the structure of the well 124 extends past the underside 140. A set of projections 144 extend from the underside 140. The set of projections 144 can be arranged complementary to the set of tines 118 of the first grate 112 (FIG. 2) to ensure proper alignment among the griddle 120 and the first grate 112 during attachment of the griddle 120 to the first grate 112. As can be appreciated, some projections of the set of projections 144 includes a longitudinal portion 146 and a lateral portion 148 extending from the longitudinal portion 146, while some projections of the set of projections 144 include only a longitudinal portion 146. It should be understood that any suitable arrangement for the set of projections 144 is contemplated, including any arrangement, number, or system of projections, with or without longitudinal portions 146 or lateral portions 148, or any other portion, including but not limited to, curved projections, linear projections, angled projections, discrete projections, or combinations thereof. The set of projections 144 align the griddle 120 relative to a complementary grate (such as the first grate 112 of FIG. 2) beneath the griddle 120. Therefore, the particular arrangement of the set of projections 144 is dependent upon the particular grate that the griddle 120 is being attached to. The set of projections 144 can be tailored to the particular grate to permit attachment and alignment to a single intended position, to prevent, minimize, or eliminate occurrences of misalignment or mispositioning of the griddle 120, as well as preventing sliding movement of the griddle 120 along the first grate 112 when in the down position, the up position, or moving between positions.

Figure 4A:
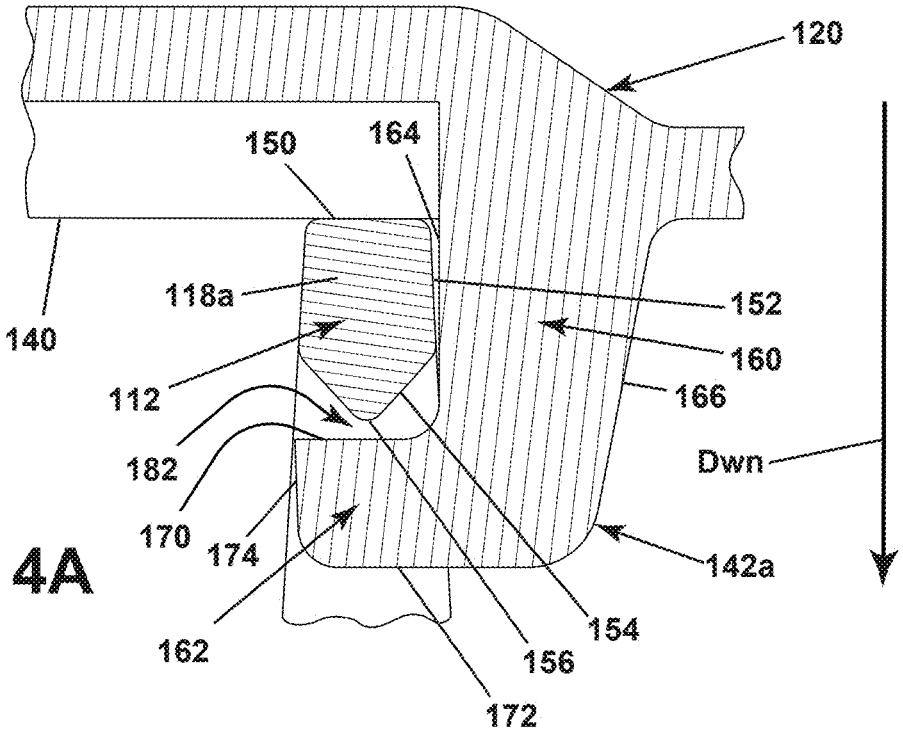
FIG. 4A is a sectional view of one hook of the set of hooks of FIG. 2 taken across section IVB-IVB, showing the position of the hook relative to the grate, in accordance with an aspect of the present disclosure.
Figure 4B:
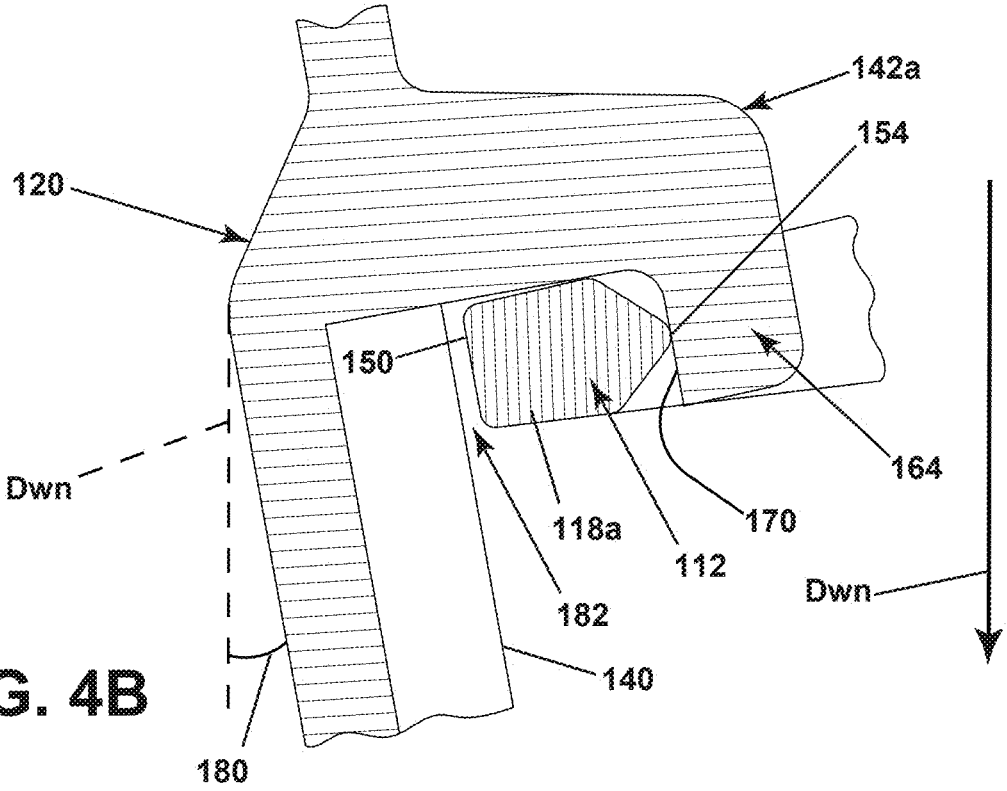
FIG. 4B shows the sectional view of FIG. 4A, also taken across section IVB-IVB rotated to show an orientation of the hook and the grate in the up position at an angle relative to a down direction, in accordance with an aspect of the present disclosure.

Referring to FIGS. 4A and 4B collectively, FIG. 4B depicts a section view, taken along section VIB-VIB of FIG. 2, illustrating one hook 142*a* of the first set of hooks 142*a* (FIG. 2) positioned about the tine 118*a* of the set of tines 118 (FIG. 1), and with the griddle 120 and first grate 112 oriented in the up position, similar to that as shown in FIG. 2. FIG. 4A shows the same section view, while having the griddle 120 and first grate 112 oriented in the up position, similar to that as shown in FIG. 1. As is appreciable, the griddle 120 is attached to the first grate 112 via attachment of the hook 142*a* to the tine 118*a* in both the down position (FIG. 4A) and the up position (FIG. 4B). A downward direction (Dwn) can be aligned with the direction of gravity acting upon the cooktop 100 and can be arranged perpendicular to the cooking surface 122 of the griddle 120 when the cooktop 100 and the griddle 120 are level when in the down position. The downward direction (Dwn) can be utilized for reference for understanding the orientation of the hook 142*a* relative to the tine 118*a* despite moving between the up position and the down position.

Referring to FIG. 4A, the first grate 112 is oriented in the down position, with the underside 140 of the griddle 120 resting upon a top surface 150 of the tine 118*a*. The hook 142*a* includes a shank portion 160 extending from the underside 140 and a finger portion 162 extending from the shank portion 160. The shank portion 160 can include an inner surface 164 and an outer surface 166. At least a portion of the inner surface 164 confronts or abuts a side 152 of the tine 118*a*. The finger portion 162 includes an upper surface 170 facing and a lower surface 172 opposite of the upper surface 170. An end surface 174 extends between the upper surface 170 and the lower surface 172. The bottom surface 154 is formed as a rounded point 156. The rounded point 156 is spaced from the upper surface 170 when the first grate 112 is in the down position. In the up position (FIG. 4B) the rounded point 156 can contact the upper surface 170 of the finger portion 162, while the underside 140 is spaced from the top surface 150, i.e., the griddle 120 is being slid away from the first grate 112, while being secured at the finger portion 162 of the hook 142*a*.

Still referring to FIG. 4A, when the first grate 112 is in the down position, the griddle 120 rests upon the top surface 150 of the tine 118*a* and sliding movement of the griddle 120 toward the tine 118*a* is prevented by contact among the inner surface 164 of the hook 142*a* against the side 152 of the tine 118*a*. As can be appreciated, sliding movement may be permitted in an opposite direction, where the inner surface 164 is moved away from the side 152 of the tine 118*a*, while such sliding movement may be limited or prevented by the set of projections 144 (FIG. 3), while still permitting attachment or removal of the griddle 120 at the first grate 112 at the hook 142*a*.

Referring now to FIG. 4B, the first grate 112 is positioned in the up position. The up position can be arranged at an angle 180 relative to the down direction (Dwn), while alignment with the down direction (Dwn) is contemplated. The orientation of the first grate 112 in the up position when the angle 180 is unaligned from the down direction (Dwn) results in an orientation that is slightly tilted (when the angle 180 is non-zero relative to the down direction (Dwn)). Such a tilt can permit the underside 140 of the griddle 120 to slide away from the top surface 150 of the hook 142*a* due to gravity acting upon the griddle 120. Despite such a tilt, the finger portion 162 prevents the griddle 120 from separating from the first grate 112 when in the up position. Specifically, the upper surface 170 of the finger portion 162 contacts and abuts the bottom surface 154 of the tine 118*a*, preventing the griddle 120 from separating from the first grate 112. Furthermore, even when the angle 180 is zero, such that the griddle 120 is aligned with the down direction, a griddle without the hook may be permitted to separate from the first grate 112, such as due to user contact such as bumping such as griddle during cleaning. The hook 142*a* prevents unintended separation of the griddle 120 from the first grate 112, even where the up position does not tend to result in sliding separation among the two.

It should be appreciated that the sizing of the tine 118*a* can be such that at least a small gap exists between the hook 142*a* and a portion of the tine 118*a*. For example, in FIG. 4A, a gap 182 exists between the bottom surface 154 of the tine 118*a* and the upper surface 170 of the finger portion 162 of the hook 142*a*. In FIG. 4B, sliding movement of the griddle 120 moves the gap 182 to between the top surface 150 of the tine 118*a* and the underside 140 of the griddle 120. In alternative examples, it is contemplated that no gap 182 exists, while such a gap can be beneficial in providing room for attachment of the griddle 120 to the first grate 112.

In use, the hook 142*a*, and the set of hooks 142 (FIG. 3) permit continued attachment of the griddle 120 to the first grate 112 even when positioned in the up or down position, or pivoting between the up position and the down position. Such attachment permits cleaning of the cooktop 100 without removing the griddle 120, saving time and improving user experience. Furthermore, a secure attachment of the griddle 120 reduces or prevents the occurrence of accidental disconnection or dropping of the griddle 120, which reduces the occurrence of spills, injury, or damage, as well as improving user experience.

Many other possible embodiments and configurations in addition to that shown in the above figures are contemplated by the present disclosure. To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. Moreover, while "a set of" or "a plurality of" various elements have been described, it will be understood that "a set" or "a plurality" can include any number of the respective elements, including only one element. Combinations or permutations of features described herein are covered by this disclosure.

This written description uses examples to disclose embodiments of the disclosure, including the best mode, and to enable any person skilled in the art to practice embodiments of the disclosure, including making and using any devices or systems and performing any incorporated methods. The patentable scope of the disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A cooktop comprising: a grate, arranged as a set of interconnected tines and movable between a down position wherein the grate is positioned over a burner and an up position wherein the grate is spaced away from the burner; a griddle, removably coupled to the grate, the griddle including a cooking surface and an underside of the griddle opposite the cooking surface; and a hook extending from the underside of the griddle and wherein the hook secures the griddle to the grate including when the grate is in the up position, the down position, or moving between the up position and the down position.

The cooktop of any preceding clause, wherein the hook comprises a shank portion extending from the underside of the griddle and a finger portion extending from the shank portion.

The cooktop of any preceding clause, wherein the griddle rests upon a top surface of the grate in the down position.

The cooktop of any preceding clause, wherein an inner surface of the shank portion contacts a side of at least one tine of the set of interconnected tines when the grate is in the down position.

The cooktop of any preceding clause, wherein the finger portion includes an upper surface of the finger portion facing a bottom surface of the grate in the down position.

The cooktop of any preceding clause, wherein the bottom surface of the grate is formed as a rounded point.

The cooktop of any preceding clause, further comprising a gap between the upper surface of the finger portion and the bottom surface of the grate when the grate is in the down position.

The cooktop of any preceding clause, wherein the gap is between the underside of the griddle and the top surface of the grate in the up position.

The cooktop of any preceding clause, wherein at least one tine of the set of interconnected tines is positioned between the underside of the griddle and the finger portion.

The cooktop of any preceding clause, wherein the grate contacts the underside of the griddle in the down position and is spaced from the underside of the griddle in the up position.

The cooktop of any preceding clause, wherein the grate is angled from a down direction when positioned in the up position.

The cooktop of any preceding clause, further comprising a set of projections extending from the underside and arranged complementary to the grate to align the griddle relative to the grate.

The cooktop of any preceding clause, wherein at least some projections of the set of projections comprise longitudinal portions.

The cooktop of any preceding clause, wherein the at least some projections of the set of projections that comprise longitudinal portions further comprise lateral portions extending from the longitudinal portions.

The cooktop of any preceding clause, further comprising a body carrying a set of burners.

The cooktop of any preceding clause, further comprising a hinge pivotably coupling the grate to the body.

The cooktop of claim any preceding clause, wherein the grate pivots about the hinge to move between the down position and the up position.

A griddle removably attachable to a grate arranged on a cooktop, the grate movable between an up position and a down position, the griddle comprising: a cooking surface; an underside opposite of the cooking surface; and at least one hook extending from the underside; wherein the hook secures the griddle to the grate during movement of the grate between the up position and the down position.

The griddle of any preceding clause, further comprising a set of projections extending from the underside.

The griddle of any preceding clause, wherein the hook is sized to define a gap between at least a portion of the hook and the grate when the griddle is attached to the grate.

A system for cooking a food item on a cooktop, the system comprising: a grate comprising a set of interconnected tines, the grate movable between an up position and a down position; and a griddle removably coupled to the grate and comprising a set of hooks adapted to secure to the set of interconnected tines during movement of the grate between the up position and the down position.

The system of any preceding clause, wherein each hook of the set of hooks comprises a shank portion extending from an underside of the griddle, and a finger portion extending from the shank portion.

The system of any preceding clause, wherein the finger portion is spaced from the grate when the grate is in the down position, and wherein the finger portion contacts the grate in the up position.

The system of any preceding clause, further comprising a set of projections extending from the griddle configured to align the griddle relative to the grate.

The system of any preceding clause, wherein each hook of the set of hooks is shaped to position on at least three sides one tine of the set of interconnected tines.

What is claimed is:

1. A cooktop comprising:

a grate, arranged as a set of interconnected tines and pivotable between a down position wherein the grate is positioned over a burner and an up position wherein the grate is spaced away from the burner;

a griddle, removably coupled to the grate, the griddle including a cooking surface and an underside of the griddle opposite the cooking surface; and a hook extending from the underside of the griddle and wherein the hook secures the griddle to the grate including when the grate is in the up position, the down position, or moving between the up position and the down position.

2. The cooktop of claim 1, wherein the hook comprises a shank portion extending from the underside of the griddle and a finger portion extending from the shank portion.

3. The cooktop of claim 2, wherein the griddle rests upon a top surface of the grate in the down position.

4. The cooktop of claim 3, wherein an inner surface of the shank portion contacts a side of at least one tine of the set of interconnected tines when the grate is in the down position.

5. The cooktop of claim 4, wherein the finger portion includes an upper surface of the finger portion facing a bottom surface of the grate in the down position.

6. The cooktop of claim 5, wherein the bottom surface of the grate is formed as a rounded point.

7. The cooktop of claim 5, further comprising a gap between the upper surface of the finger portion and the bottom surface of the grate when the grate is in the down position.

8. The cooktop of claim 7, wherein the gap is between the underside of the griddle and the top surface of the grate in the up position.

9. The cooktop of claim 2, wherein at least one tine of the set of interconnected tines is positioned between the underside of the griddle and the finger portion.

10. The cooktop of claim 2, wherein the grate contacts the underside of the griddle in the down position and is spaced from the underside of the griddle in the up position.

11. The cooktop of claim 1, wherein the grate is angled from a down direction when positioned in the up position.

12. The cooktop of claim 1, further comprising a set of projections extending from the underside and arranged complementary to the grate to align the griddle relative to the grate.

13. The cooktop of claim 12, wherein at least some projections of the set of projections comprise longitudinal portions.

14. The cooktop of claim 13, wherein the at least some projections of the set of projections that comprise longitudinal portions further comprise lateral portions extending from the longitudinal portions.

15. The cooktop of claim 1, further comprising a body carrying a set of burners.

16. The cooktop of claim 15, further comprising a hinge pivotably coupling the grate to the body.

17. The cooktop of claim 16, wherein the grate pivots about the hinge to move between the down position and the up position.

18. A griddle removably attachable to a grate arranged on a cooktop, the grate movable between a non-horizontal up position and a horizontal down position, the griddle comprising:

a cooking surface;

an underside opposite of the cooking surface; and at least one hook extending from the underside;

wherein the hook secures the griddle to the grate during movement of the grate between the up position and the down position.

19. The griddle of claim 18, further comprising a set of projections extending from the underside.

20. The griddle of claim 19, wherein the hook is sized to define a gap between at least a portion of the hook and the grate when the griddle is attached to the grate.

* * * * *